United States Patent [19]

Kastlunger

[11] Patent Number: 4,648,362

[45] Date of Patent: Mar. 10, 1987

[54] DECOMPRESSION ARRANGEMENT FOR A COMBUSTION ENGINE

[75] Inventor: Siegfried Kastlunger, Schaerding, Austria

[73] Assignee: Motorenfabrik Hatz GmbH & Co. KG, Ruhstorf, Fed. Rep. of Germany

[21] Appl. No.: 820,489

[22] Filed: Jan. 17, 1986

[30] Foreign Application Priority Data

Feb. 27, 1985 [DE] Fed. Rep. of Germany ..... 3506964

[51] Int. Cl.[4] ..... F01L 13/08

[52] U.S. Cl. ..... 123/182; 123/90.16

[58] Field of Search ..... 123/182, 90.16, 316

[56] References Cited

U.S. PATENT DOCUMENTS 3,735,745 5/1973 Hatz ..... 123/182

4,338,893 7/1982 Pomfret et al. ..... 123/182

*Primary Examiner*—Andrew M. Dolinar

*Attorney, Agent, or Firm*—Flynn, Thiel, Boutell & Tanis

[57] ABSTRACT

A decompression apparatus for an internal combustion engine includes an adjustable eccentric decompression cam which pivotally supports a rocker arm which controls a valve. A switching member supported on and operable by the rocker arm during decompression causes the cam to move in progressive steps from a decompression position to a non-decompression position. The switching member is moved to an operative position at the start of decompression by one of two projections provided on the cam, and as the cam moves into its non-decompression position the other of the projections thereon moves the switching member to a non-operative position. A locking mechanism releasably holds the switching member in its non-operative position.

6 Claims, 11 Drawing Figures

20
35
34
30a
30
32
36
32b
20b
24
20a
32a
16
30y
30b
22
E
22a
26
14
30x
18
10
10b
12
12a
H
10a
22
22n
38
38a
10c
28a
28
10
30
35
24
20
20b
20a
32b
30a
III
36
34
38
32
10c
22n
22a

Fig. 4
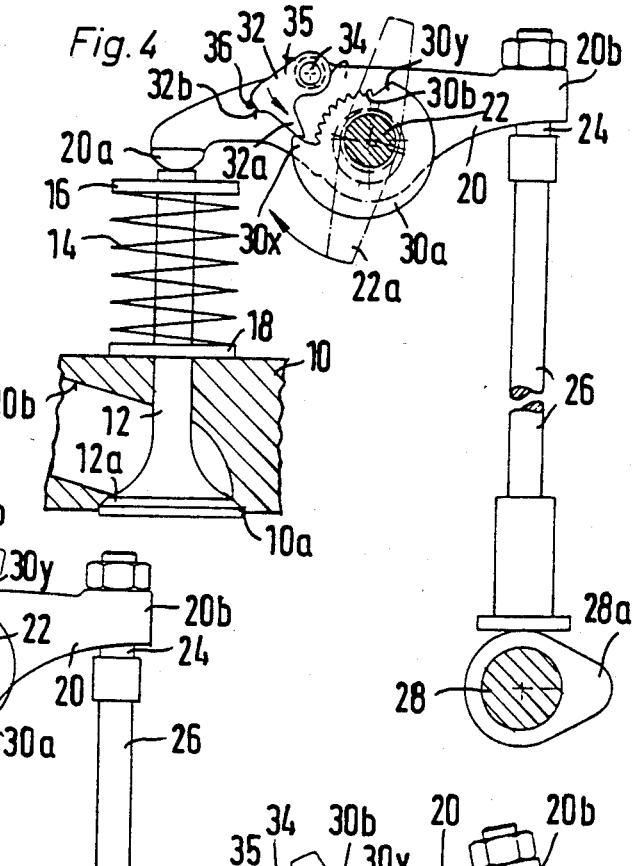
Fig. 5
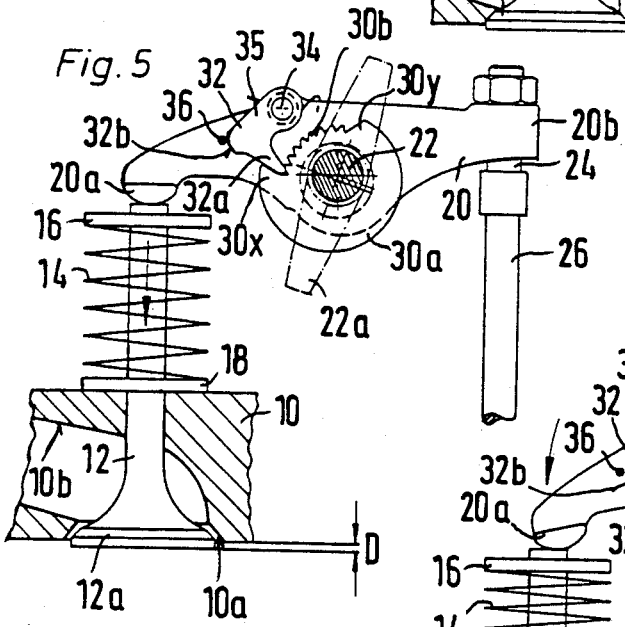
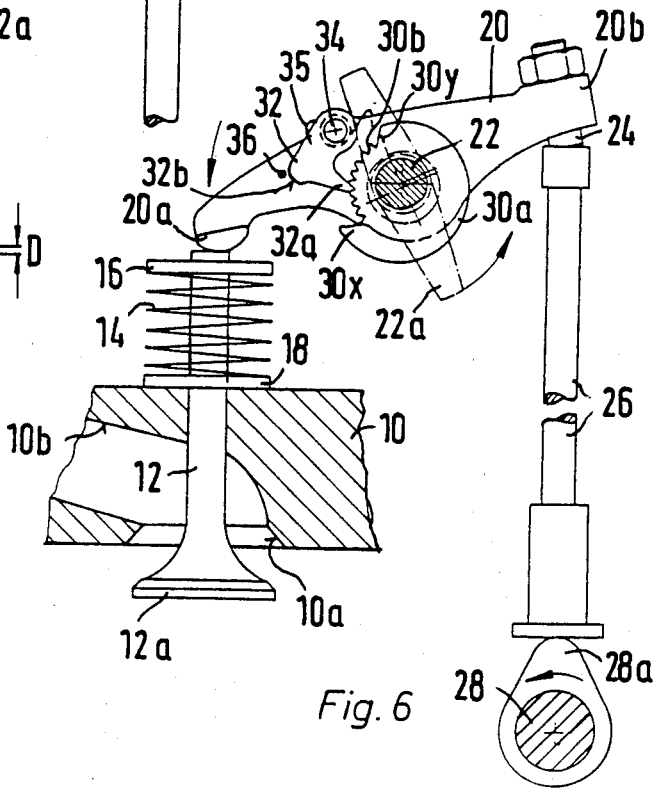
Fig. 6

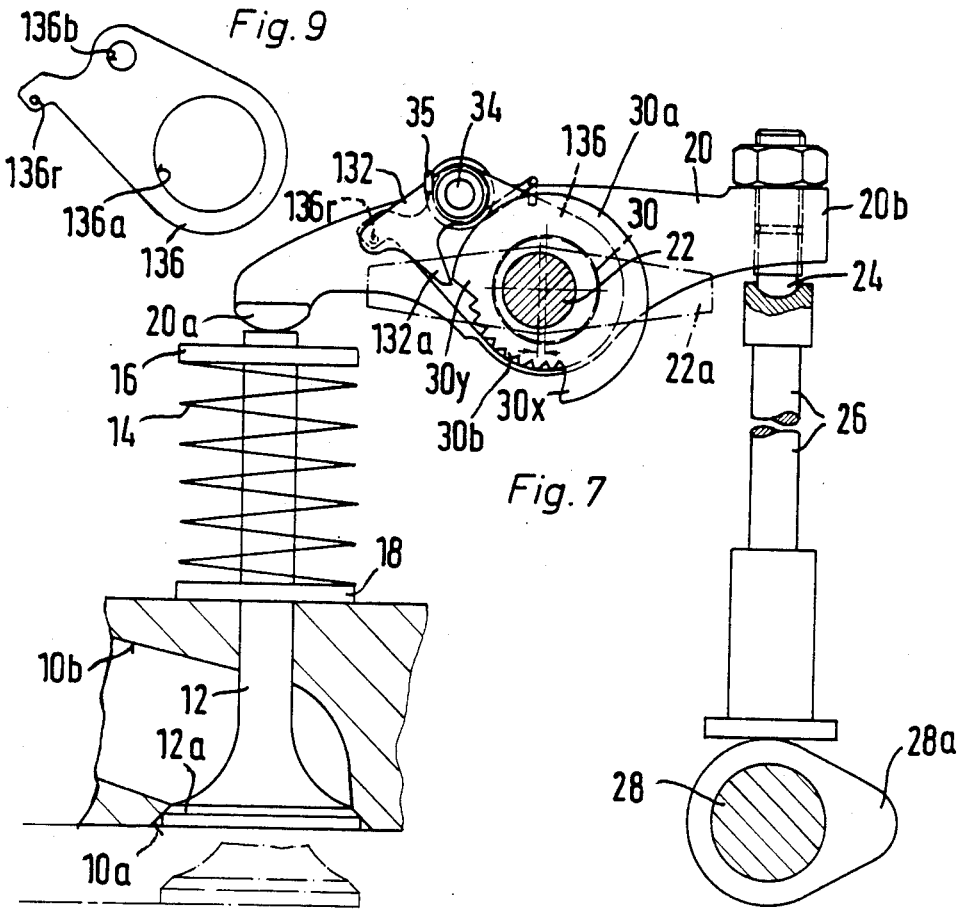
Fig. 9
Fig. 7
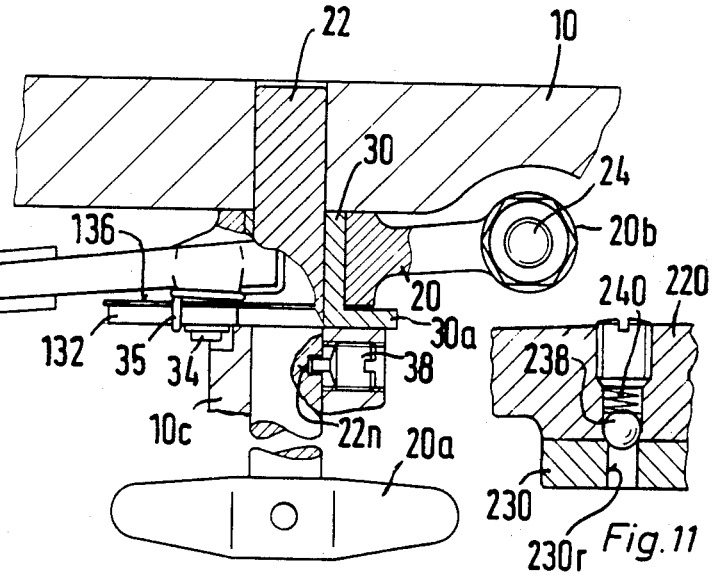
Fig. 8
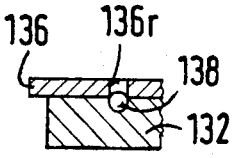
Fig. 10
Fig. 11

DECOMPRESSION ARRANGEMENT FOR A COMBUSTION ENGINE

FIELD OF THE INVENTION

This invention relates to a decompression arrangement for an internal combustion engine.

BACKGROUND OF THE INVENTION

Various decompression devices for combustion engines are known. However, most of these have a complicated design and are therefore not economical to manufacture and service. In addition, they require an extremely wide range of movement for operation, which necessitates a large clearance, and they are therefore scarcely suitable for use in differing engine types.

It is an object of the present invention to obviate these disadvantages of known decompression devices and to provide a decompression arrangement which is capable of manufacture with a minimum number of components and which operates over a very narrow range of movement.

SUMMARY OF THE INVENTION

The invention provides a decompression arrangement for an internal combustion engine which has a valve controlled by a rocker arm, the decompression arrangement including an adjustable eccentric decompression cam which serves as fulcrum for the rocker arm and a switching member which is operable by the rocker arm and moves the eccentric cam in progressive steps away from a decompression position in a direction toward a non-decompression position, wherein the switching member is supported on the rocker arm and, upon terminating the decompression, is brought into a non-operative position by a projection on the eccentric cam and is held in this position by a releasable locking mechanism, and wherein, upon activating decompression, a further projection provided on the eccentric cam releases the locking mechanism and moves the switching member from its non-operative position into its position for decompression.

An adequate locking effect is, for example, achievable if the locking mechanism includes a resiliently flexible retaining pin secured to the rocker arm and a circumferential surface on the switching member, the switching member being designed as a racking pawl and the circumferential surface thereon cooperating with the pin. However, the locking mechanism may alternatively be designed as a hole in a locking plate connected to move with the rocker arm, and a locking projection located in the pawl and engaging the plate. A locking mechanism may also alternatively include a hole provided in the pawl and a spring-loaded projection supported on the rocker arm and engageable with the hole. In the decompression mode, the pawl operates in conjunction with a serration in the circumference of the eccentric cam, and the two projections on the cam are arranged at respective ends of this serration.

BRIEF DESCRIPTION OF THE DRAWINGS

There will now be described various examples of arrangements according to the invention with reference to the drawings and by way of example only and not by way of limitation. In the drawings:

FIGS. 4–6 are each a fragmentary elevational side view similar to FIG. 1 and show the inventive arrangement in three different operating positions in the decompression mode;

FIGS. 7 and 8 are views which are respectively similar to FIGS. 1 and 2 but show an alternative embodiment of the arrangement in FIGS. 1 and 2;

FIG. 9 is a side view of an element which is a component of the arrangement of FIGS. 7 and 8;

FIG. 10 is a fragmentary sectional view in an enlarged scale of a portion of the arrangement shown in FIG. 8; and FIG. 11 is a fragmentary sectional view showing a variation of a locking mechanism for a racking pawl which is a component of the arrangement shown in FIG. 1.

DETAILED DESCRIPTION

Figures 1, 2, 3:
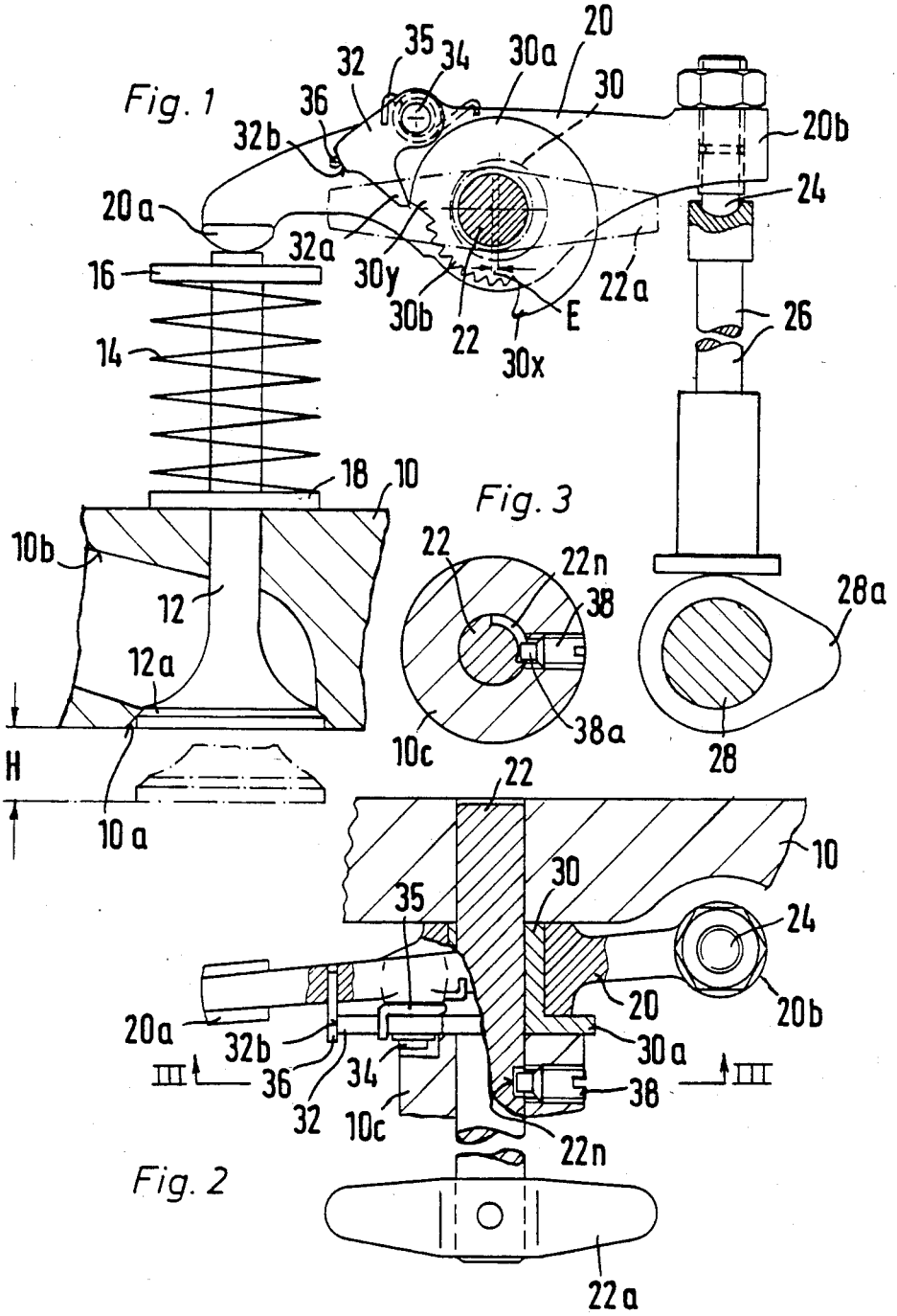
FIGS. 1 and 2 are respectively a fragmentary elevational side view and a fragmentary top view of pertinent parts of an engine embodying a decompression arrangement according to the present invention.
FIG. 3 is a sectional view taken along line III—III in FIG. 2.

An inlet valve 12 is movably supported in the normal way in a cylinder head 10 of a conventional internal combustion engine which is not depicted in detail in its entirety, the valve head 12*a* being seated against a valve seat 10*a* of the cylinder head 10 and opening and closing an inlet port 10*b* during a cycle of operation, through which inlet port 10*b* combustion gases enter the cylinder combustion chamber (not shown).

The valve 12 is moved into its closed position by a spring 14 disposed between a spring abutment or disc 16 fixed to the valve stem and a spring abutment or disc 18 situated on the head 10. A double armed rocker lever or arm 20 is pivotally supported on a fulcrum pin 22 and operates the valve 12 with an arm 20*a* which engages the top end of the valve 12, while its other arm 20*b* carries an adjusting screw 24, which engages the top end of a push rod 26. During operation, the push rod 26 is vertically reciprocated by means of engagement of the lower end thereof with a control cam 28*a* provided on a shaft 28 rotationally driven by the crank shaft of the engine, and upward movement of the push rod 26 causes the rocker arm 20 to be pivoted about the fulcrum pin 22 in a counterclockwise direction as viewed in FIG. 1. The valve 12 is thus moved downwards from its closed position into its open position, which is marked in broken lines in FIG. 1. The combustion gas can then be drawn through the port 10*b*.

The decompression device described below is provided to assist in starting the motionless engine. The rocker arm 20 is pivotally supported on the fulcrum pin 22 by a sleevelike eccentric cam 30, which is located therebetween, which has an eccentricity E with respect to the axis of the fulcrum pin 22, and which has at one axial end a radially extending flange 30*a* having a serration 30*b* along a portion of a radially outer edge thereof. At each end of the serration is a respective projection 30*x* or 30*y*. The eccentric cam 30 is nonrotatably secured on the fulcrum pin 22 by a conventional and not-illustrated arrangement such as axially extending slots having a key therein. This pin has a handle 22*a* fixedly secured on an end thereof projecting from the cylinder head 10 through an opening in a wall 10*c*, the handle 22*a* being used to rotate the pin 22 together with the eccentric cam 30, the pin 22 being rotatably supported. A racking pawl 32 is pivotally supported on a pin 34 provided on the rocker arm 20, and is urged in a counterclockwise direction in FIG. 1 by a weak torsion spring 35. The pawl 32 has a racking projection 32*a*, and has a peripheral surface 32*b* which cooperates with a retaining or blocking pin 36 secured to the rocker arm 20. This retaining or blocking pin is designed to be resiliently flexible to a limited degree so that, upon engagement of the pin 20 and the peripheral surface 32*b* of the pawl 32 (FIG. 1), a frictional locking contact is produced between the components 32 and 36 and holds the pawl 32 in a non-operative position.

During normal operation of the engine, the decompression components assume the position depicted in FIGS. 1 and 2, from which position the inlet valve 12 cyclically executes its normal stroke H for opening and closing the inlet port 10*b*.

When the engine is not running and is to be started, the eccentric cam 30 of the decompression device is turned in a clockwise direction (by means of the handle 22*a*) from the position shown in FIG. 1 to a decompression position shown in FIG. 5. As a result, the projection 30*x* engages the racking projection 32*a* of the pawl 32 (FIG. 4) and moves the pawl 32 into engagement with the serration 30*b* on the eccentric cam 30 (FIG. 5) and out of frictional locking contact with the pin 36. Since the push rod 26 is not moved at this time, the rocker arm 20 is turned a very small amount in a counterclockwise direction about the presently stationary point of engagement of the parts 24 and 26, this turning motion resulting from the eccentricity E and causing the end 20*a* of the rocker arm 20 to depress the valve 12 away from its closed position by an amount D (FIG. 5) which corresponds to the eccentricity E to a partially open position for decompression.

If the engine is now started manually or by means of a starter, its crankshaft rotates and the valve 12 will move cyclically from its decompression position (FIG. 5) into its open position (FIG. 6) and back. During each movement of the rocker arm 20 in a counterclockwise direction, the racking pawl 32 turns and, due to engagement of its racking projection 32*a* with the serration 30*b*, it turns the eccentric cam 30 in a counterclockwise direction by an amount corresponding to the angle of the teeth thereof. During the return movement of the rocker arm 20 in a clockwise direction, the projection 32*a* on pawl 32 moves over and snaps in behind the next tooth of the serration 30*b*. This snap-in motion is caused by the spring 35. After a few cycles immediately following starting (according to the present embodiment, after 9 teeth or in other words 9 cycles), the eccentric cam 30 will have thus returned from the decompression position shown in FIG. 5 to its normal position shown in FIG. 1. Upon completion of the return of the eccentric cam 30 to its normal position (FIG. 1), the projection 30*y* engages the racking projection 32*a* of the pawl 32 and pivots this pawl in a clockwise direction to the position shown in FIG. 1, in which the pawl 32 is again retained in its non-operative position by frictional engagement with the blocking pin 36.

It is advantageous to limit the angle of movement of the fulcrum pin 22 using tangible stops, so that the setting of the decompression arrangement can be carried out by means of the handle 22*a* without any special attention having to be paid by the operator. A screw 38 (FIG. 3) may, for example, be provided in the wall 10*c* of the engine and have at its inner end a stop pin 38*a* which engages a groove 22*n* provided in the fulcrum pin 22 and having a circumferential length corresponding to the range of setting of the device.

It is obvious that the setting and operating range of the decompression device can be restricted with very close limits in accord with the invention, for example according to the embodiment of FIG. 1 to only slightly more than 90°.

The operation of the decompression device can be carried out easily in this way, and its return to a non-operative position is likewise effected in a very short time. The device itself requires only a few simply designed components, thereby enabling optimum manufacture and servicing.

A further embodiment of the releasable locking mechanism for the racking pawl is depicted in FIGS. 7 to 10. Those components of this decompression device which correspond to the components in FIGS. 1–6 are referred to with the same or similar reference numerals in FIGS. 7–10.

A racking pawl 132 pivots around the fulcrum pin 22 on the rocker arm 20, and is biased by the weak spring 35. The racking pawl 132 carries a racking projection 132*a* which cooperates with projections 30*x* and 30*y* and the serration 30*b* on the eccentric cam 30. A thin retaining or locking element 136 is disposed between the rocker arm 20 and the flange 30*a* of the eccentric cam 30, and has openings 136*a* and 136*b* in which the eccentric cam 30 and the fulcrum pin 34 are rotatably received, and the element 136 is thereby coupled for movement with the rocker arm 20. The element 136 has a hole 136*r* therein (as shown in FIG. 10 in an enlarged scale) which a locking ball 138 secured in the racking pawl 132 can releasably engage, so that in the normal operational condition shown in FIGS. 7 and 8, the pawl 132 is retained by a releasable locking effect in a non-operative position on the rocker arm 20. To initiate decompression, the eccentric cam 30 is pivoted in a clockwise direction to a position similar to that shown in FIG. 4, so that the projection 30*x* of the eccentric cam 30 engages and moves the projection 132*a* of the racking pawl 132, the locking ball 138 axially deflecting the portion of the element 136 having therein the hole 136 (upwards in FIG. 10) so that the locking effect between the parts 132 and 136 is interrupted and the racking pawl 132 is released for its intermittent switching movements.

The decompression device according to FIGS. 7–10 operates in the same basic manner as that according to FIGS. 1–6, so that the operation thereof need not be described here in detail.

At the end of the decompression phase, the projection 30*y* moves the racking pawl 132 in a clockwise direction until its locking ball 138 snaps back into the hole 136*r* in the element 136, as shown in FIG. 10.

For a type of construction in which the eccentric decompression cam lies on a planar flange of the rocker arm which extends perpendicular to the axis of the fulcrum pin 22, the retaining or locking mechanism for the racking pawl depicted in FIG. 11 in an enlarged scale may also be utilized. In particular, a locking ball 238 is movably supported in a bore in a rocker arm 220 and is biased by a spring 240, the ball 238 being engageable with a hole 230*r* provided in a racking pawl 230. Upon releasing the locking effect of these parts during setting of this arrangement to the decompression mode, the locking ball 238 is pressed into its bore in the rocker arm 220 against the urging of the spring 240, and thus the pawl 230 is in this way released and able to carry out its switching motions. In other respects, the decompression device provided with the releasable blocking mechanism of FIG. 11 operates in the same manner as the aforementioned embodiments.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A decompression apparatus for an internal combustion engine having a valve controlled by a rocker arm, comprising an adjustable eccentric decompression cam which serves as a fulcrum for the rocker arm, and a switching member which is operable by the rocker arm and moves the eccentric cam in progressive steps from a decompression position in a direction toward a non-decompression position, wherein the switching member is supported on the rocker arm and, upon termination of decompression, is brought into a non-operative position by a first projection provided on the eccentric cam and is held in this non-operative position by a releasable locking mechanism, and wherein decompression is initiated when a further projection provided on the eccentric cam releases the locking mechanism and moves the switching member from said non-operative position into said decompression position.

2. A device in accordance with claim 1, wherein the releasable locking mechanism includes a resilient flexible retaining pin secured to the rocker arm and includes a peripheral surface which is provided on the switching member and is engageable with said pin, said switching member being a racking pawl.

3. A device in accordance with claim 1, wherein the releasable locking mechanism includes a hole provided in a locking plate which is coupled with the rocker arm for movement therewith, and includes a locking projection supported on the switching member for engagement with the hole, the switching member being a racking pawl.

4. A device in accordance with claim 1, wherein the locking mechanism includes a hole provided in the switching member and a locking projection movably supported on the rocker arm and engageable with the hole.

5. A device in accordance with claim 1, wherein the switching member is a racking pawl which, during decompression, cooperates with a serration provided on the periphery of the eccentric cam.

6. A device in accordance with claim 5, wherein the first and further projections on the eccentric cam are arranged at respective ends of the serration thereon.

* * * * *